US005904597A

United States Patent [19]

Doi et al.

[11] Patent Number: 5,904,597

[45] Date of Patent: May 18, 1999

[54] SURFACE-CONTACT CONNECTOR

[75] Inventors: Etsuro Doi, Saitama; Shigeyasu Kitamura, Toyko, both of Japan

[73] Assignee: Kel Corporation, Tokyo, Japan

[21] Appl. No.: 08/819,613

[22] Filed: Mar. 17, 1997

[30] Foreign Application Priority Data

Mar. 22, 1996 [JP] Japan ..... 8-065646

[51] Int. Cl.[6] ..... H01R 13/53

[52] U.S. Cl. ..... 439/660; 439/924.1

[58] Field of Search ..... 439/924.1, 660, 439/629

[56] References Cited

U.S. PATENT DOCUMENTS

| | | | |
|---|---|---|---|
| 4,367,006 | 1/1983 | Rehbogen, Jr. et al. | 439/924.1 |
| 4,993,972 | 2/1991 | Lin | 439/924.1 |
| 5,494,463 | 2/1996 | Nishio et al. | 439/924.1 |

*Primary Examiner*—Gary Paumen
*Attorney, Agent, or Firm*—Robert W.J. Usher

[57] ABSTRACT

A surface-contact connector comprises a plurality of terminals 50 and a housing 11. The terminals 50 are made of an electrically conductive, resilient material and are formed in an identical shape. These terminals 50 are retained in the housing 11 in a row. Each terminal 50 includes an anchoring portion 51, an resilient portion 54, and a contacting portion 55. The anchoring portion 51 is fixedly retained in the housing 11, and the resilient portion 54, which is capable of elastic deformation, extends from the anchoring portion 51. The contacting portion 55 is continuous from a front end of the resilient portion 54 to protrude in the direction of engagement with a part to be electrically connected to. The housing 11 is provided with protrusion-regulating portions 16 and 17 which meet with the resilient portions 54 or contacting portions 55 of the terminals to regulate the amounts of protrusion of the contacting portions 55 in the direction of the engagement.

6 Claims, 4 Drawing Sheets

SURFACE-CONTACT CONNECTOR

FIELD OF THE INVENTION

The present invention relates to a surface-contact connector which is used, for example, for connecting a battery pack to a lap-top computer.

BACKGROUND OF THE INVENTION

Lap-top computers, because of their portability, have rapidly gained popularity. This type of computer usually incorporates a battery, which enables them to be operative anywhere irrespective of availability of an electrical power supply outlet, e.g., a wall outlet. Rechargeable battery packs are designed to be removably mounted in such computers, along with connectors to connect such battery packs to the main bodies of the computers. In general, this type of battery pack has only a plurality of electrically conductive pads (hereinafter referred to as "conductive pads") for electrical connection on the surface, and a mating connector engages with these conductive pads to establish electrical connection. This type of connector has been in use and known as "surface-contact connector".

Main roles of such battery pack are to supply electrical power to the computer in one direction and to receive electrical power for recharging itself in the other direction. However, there is a type of battery pack which includes a sensor to detect changes in the temperature during recharging process. In this battery pack, signals from this temperature sensor are conveyed to the computer through one of the conductive pads to control the supply of recharging power. Yet, there is another type of battery pack which further includes a CPU to estimate the amount of remaining charge and to control the recharging and discharging of the cells. Signals used for this control are conveyed through some of the conductive pads of the battery pack.

Here, it is clear that a surface-contact connector which is to be used for connecting such battery pack must include a plurality of terminals in correspondence with the number of conductive pads provided on the battery pack. For this reason, surface-contact connectors are generally designed in the following manner. A row of terminals, each terminal having a contacting portion, are retained in a housing to construct a surface-contact connector so that the contacting portions protrude from the housing in a row. When the battery pack is inserted or mounted into the main body of the computer, the contacting portion of each terminal of the connector is brought into engagement with a corresponding conductive pad of the battery pack to establish electrical connection.

In this type of surface-contact connector of the prior art, all the terminals are formed in an identical shape. Thus, when they are retained in the housing, the contacting portions of the terminals have the same amount of protrusion. Therefore, when the battery pack is inserted into a respective position, all the terminals of the surface-contact connector are brought into engagement with the conductive pads of the battery pack, simultaneously.

This type of surface-contact connector presents a problem when such a connector is used for a battery pack which is designed not only for charging and discharging electrical power but also for transmitting various control signals through conductive pads as previously mentioned (i.e., some conductive pads are used for connecting signal transmission in addition to a conductive pad for connecting electrical power supply). If all the conductive pads of this battery pack are brought into engagement with the terminals of the connector simultaneously as practiced in the prior art, noise caused from the power line may get onto a signal line, or even worse, discharge from the power supply may come onto a signal line and may damage an electronic device, e.g., CPU, which is connected to the signal line.

Therefore, it is desired that a power line, a grounding line, and signal lines be connected sequentially with some time differences (connection carried out in this way is hereinafter referred to as "sequential connection") while the battery pack is inserted. It is possible to achieve this sequential connection by forming the terminals of the connector in various shapes so that each terminal comes into engagement with a corresponding conductive pad of the battery pack at a different position specific to the individual terminal. However, this approach involves use of several types of terminals, which certainly increases the production cost of the connector as well as the inventory cost of the terminals.

SUMMARY OF THE INVENTION

It is an object of the present invention to provide a surface-contact connector composed of only one type of terminals yet which connector can engage with a mating part in sequential connection.

In order to achieve this objective, the present invention constructs a surface-contact connector by retaining in a housing a plurality of terminals. These terminals are made of an electrically conductive, resilient material and formed in an identical shape. Each terminal comprises an anchoring portion, an resilient portion, and a contacting portion. The anchoring portion is fixedly retained in the housing, and the resilient portion which is capable of undergoing elastic deformation extends from the anchoring portion. The contacting portion is continuous from a front end of the resilient portion and protrudes from the housing in the direction of engagement with a part to be electrically connected to. The housing is provided with protrusion-regulating portions which meet with the resilient portions or contacting portions of the terminals to regulate the amounts of protrusion of the contacting portions in the direction of the engagement.

In this surface-contact connector, each protrusion-regulating portion is shaped different, so the protrusion of the contacting portion of each terminal is different in the housing. With this surface-contact connector, sequential connection is realized for insertion of a battery pack. When a battery pack is inserted or mounted into a predetermined position to engage with the surface-contact connector, the electrically conductive pads of the battery pack are brought into engagement with the contacting portions of the terminals of the surface-contact connector individually at different timing in accordance with the protrusion of the individual contacting portion. This surface-contact connector, even though it is composed of identical terminals, is made capable of enabling sequential connection only by the provision of a variation to the shapes of the protrusion-regulating portions of the housing. Moreover, this variation is easily provided to each protrusion-regulating portion to vary the protrusion of a respective terminal by forming a die accordingly before molding the housing with little increase in the production cost.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention and wherein.

DESCRIPTION OF THE PREFERRED EMBODIMENTS

Figure 1:
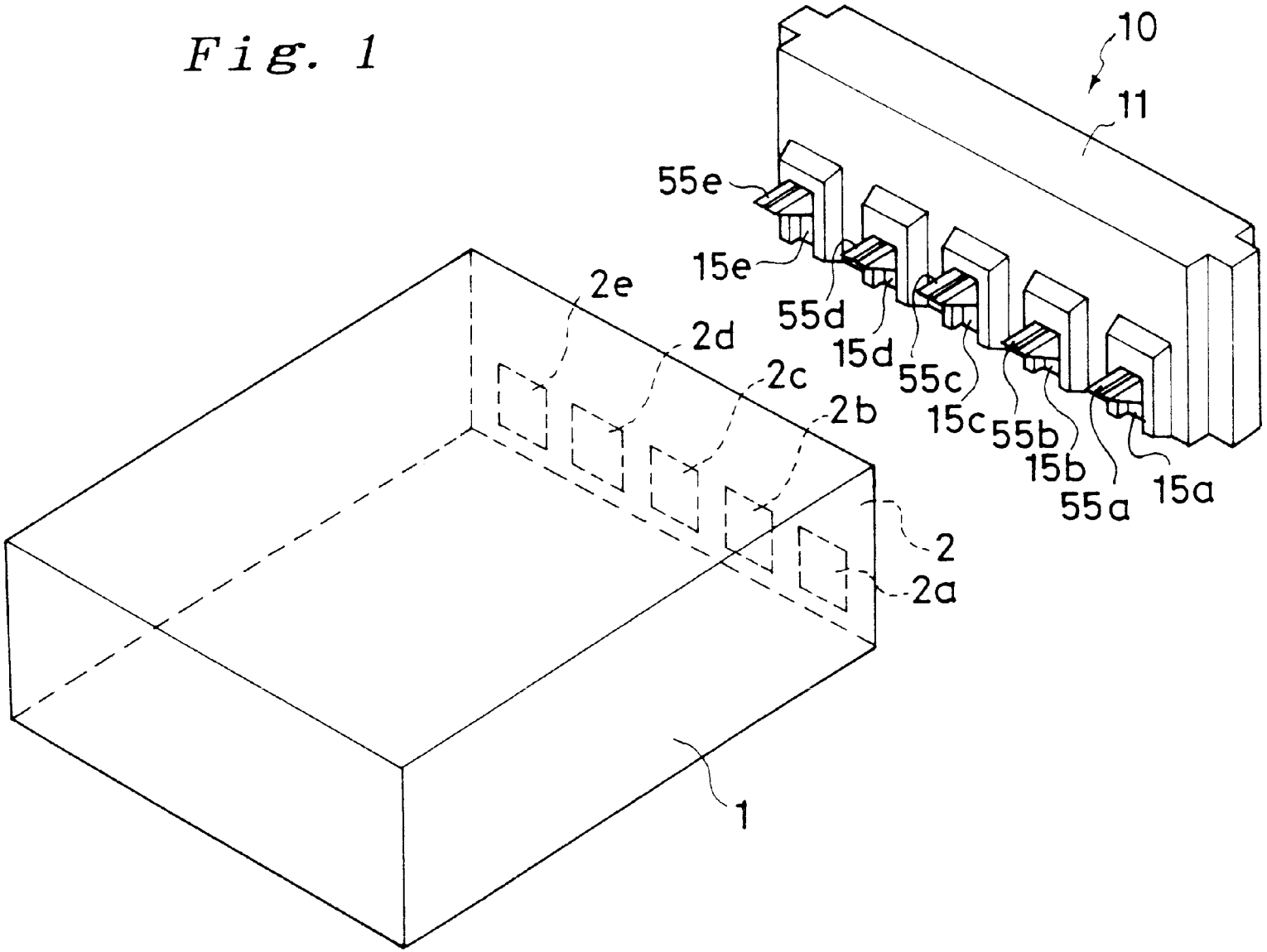
FIG. 1 is a perspective view of a surface-contact connector according to the present invention and a battery pack, which is engaged with this connector.

FIG. 1 shows a surface-contact connector 10 of the present invention and a battery pack 1, which is a part to be electrically connected by this connector 10. This battery pack 1 is of a type which is used for lap-top computers and is capable of being removably inserted into a predetermined position of a respective computer. The surface-contact connector 10 is mounted at the predetermined position, facing a plurality of electrically conductive pads 2*a*–2*e* (five in this example) which are provided on a rear face 2 of the battery pack 1.

Figure 2A:
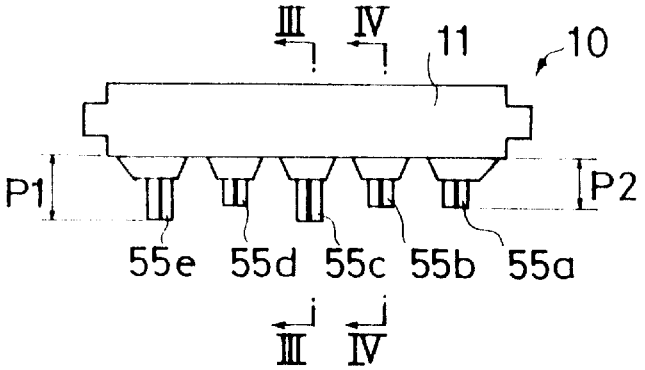
FIG. 2A is a plan view of the surface-contact connector.
Figure 2B:
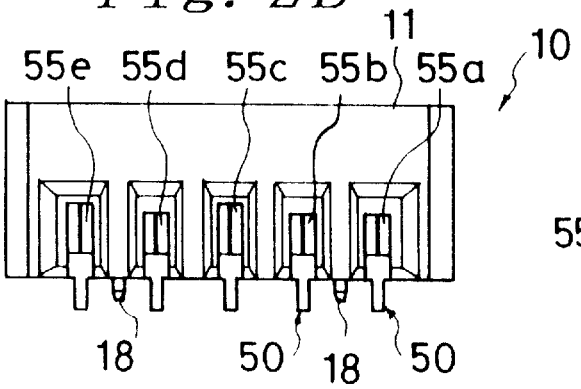
FIG. 2B is a front view of the surface-contact connector.
Figure 2C:
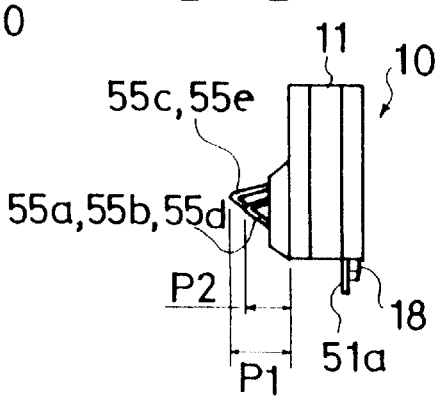
FIG. 2C is a side view of the surface-contact connector.

FIGS. 2A, 2B, and 2C also show the exterior of the surface-contact connector 10. The surface-contact connector 10 comprises an insulation housing 11 and a row of five terminals 50, which are aligned laterally and retained in the housing 11. These five terminals 50 are identical, but the amounts of protrusion (P1 and P2) of the contacting portions 55 (55*a*–55*e*) of the terminals 50 vary because they are retained in the housing 11 each in a different way.

Figure 6A:
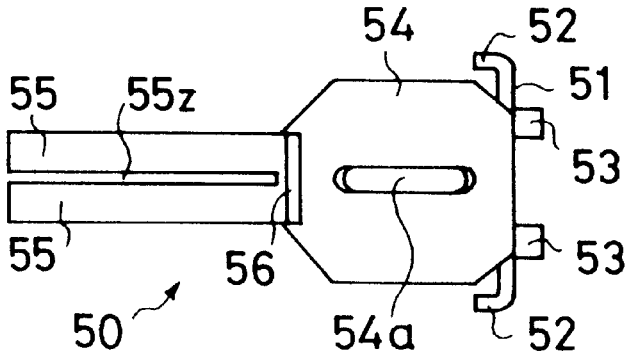
FIG. 6A is a plan view of a terminal used in the surface-contact connector.
Figure 6B:
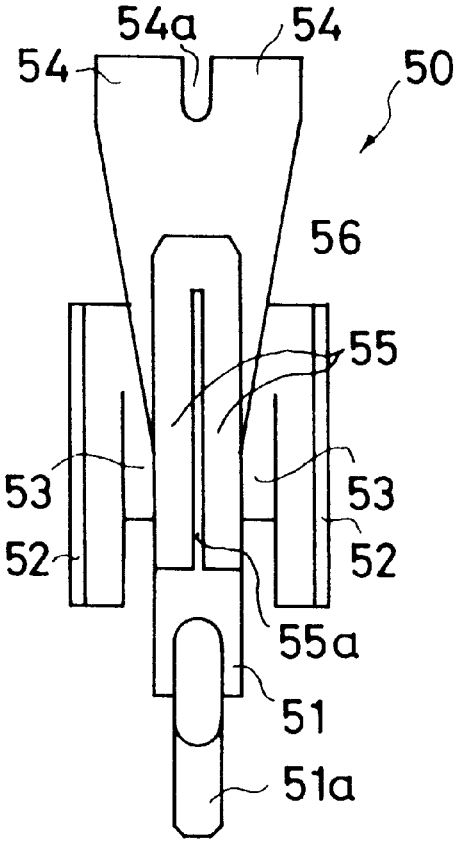
FIG. 6B is a side view of the terminal.
Figure 6C:
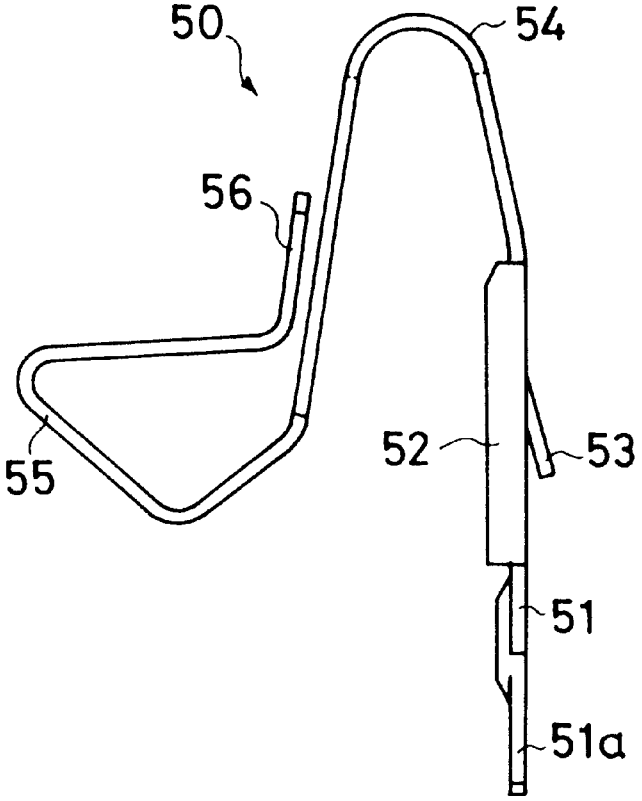
FIG. 6C is a front view of the terminal.

First, the terminals 50 are described with reference to FIG. 6. Each terminal 50 is made of a sheet of an electrically conductive material (e.g., metal plate) and formed in one piece as shown in the figure. It basically comprises an anchoring portion 51, a resilient portion 54, and a contacting portion 55. The anchoring portion 51 is retained fixedly in the housing 11, and the resilient portion 54 extends upward from the anchoring portion 51 in an inverted "U" curve. The contacting portion 55 extends forward from the resilient portion 54 further and folds back. Furthermore, a lead portion 51*a* extends downward from the anchoring portion 51. To mount the connector 10, this lead portion 51*a* is soldered, for example, to the circuit board of the computer (not shown).

The anchoring portion 51 is relatively wide, and the portions near both the side-edges are bent inward by 90 degrees, each portion forming an insertion guide portion 52. Slits extends upward in four lines along both the lateral insertion guide portions 52, and the portions defined between these slits are bent rearward forming a (right and left) pair of lances 53. The resilient portion 54 is relatively wide at the uppermost part, where an opening 54*a* extends longitudinally at the center. The contacting portion 55 is a relatively narrow strip, which has a longitudinally extending slit 55*z* at the center. This slit 55*z* closes near the upper end of the contacting portion 55, which bends along and over the resilient portion 54 and forms a folded portion 56.

Figure 3A:
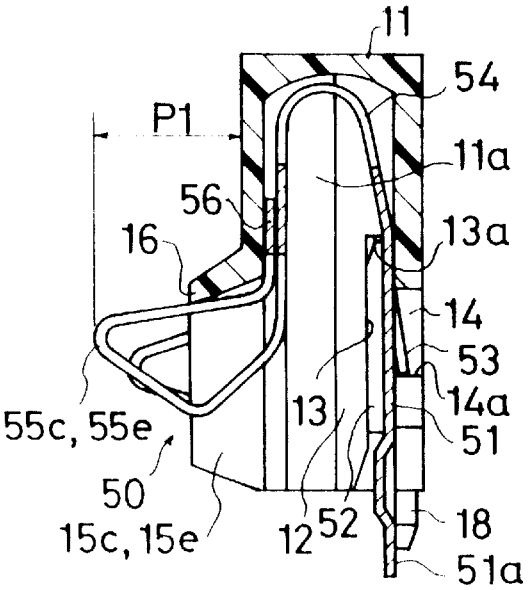
FIG. 3A is an enlarged cross-sectional view of the surface-contact connector, taken along line III—III in FIG. 2A.
Figure 3B:
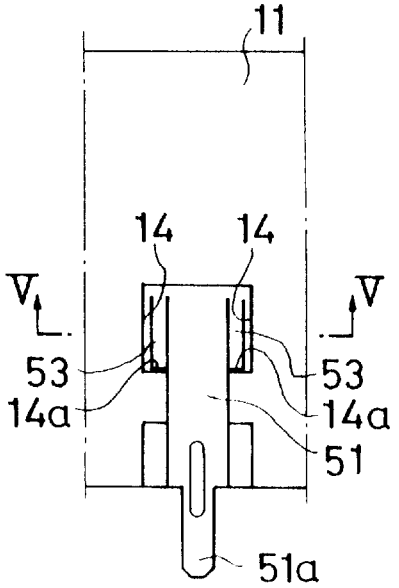
FIG. 3B is an enlarged, partial, rear view of the surface-contact connector.
Figure 4:
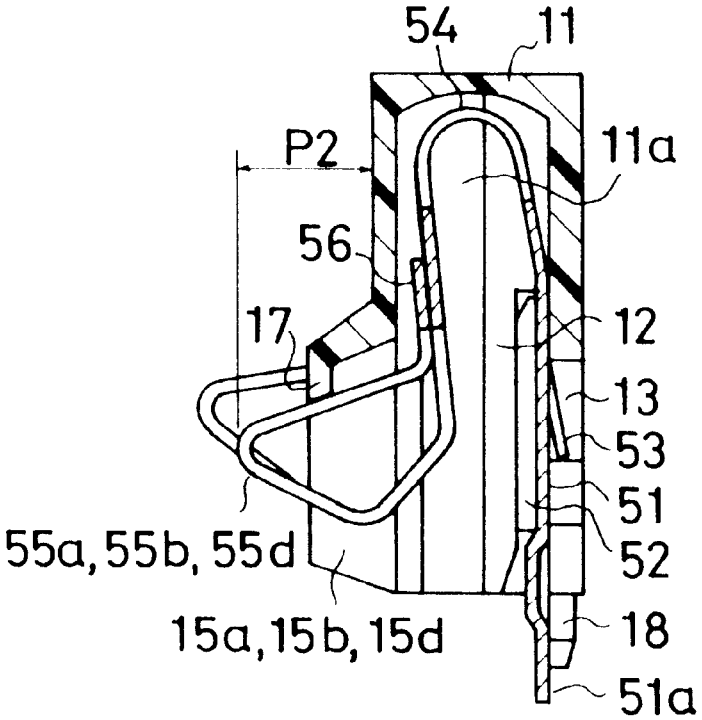
FIG. 4 is an enlarged cross-sectional view of the surface-contact connector, taken along line IV—IV in FIG. 2A.
Figure 5:
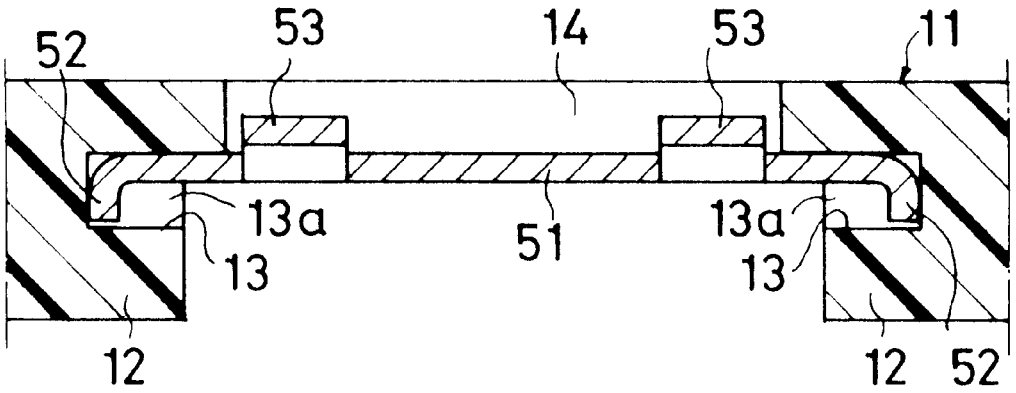
FIG. 5 is an enlarged, partial, cross-sectional view of the surface-contact connector, taken along line V—V in FIG. 3B.

To retain laterally a row of terminals 50, which are constructed as described above, the housing 11 has five terminal slots 11*a*, which are aligned laterally. Each terminal slot 11*a* is open to the lower surface of the housing is, and a portion of the slot 11*a* which is hereinafter referred to as contact opening 15*a*–15*e* is open at the lower front portion of the housing 11 as shown in FIGS. 3A and 3B and FIG. 4. When the terminals 50 are retained in these terminal slots 11*a*, the contacting portions 55 of the terminals 50 protrude forward from the housing 11 as shown in the figures. In the figures, they are labeled with 55*a*–55*e*, respectively.

The contacting portions 55*a*, 55*b*, and 55*d* are all set to the same amount of protrusion P2, and the contacting portions 55*c* and 55*e* are both set to the same amount of protrusion P1, which is greater than P2. When the battery pack 1 is inserted into the predetermined position, the conductive pads 2*a*–2*e* of the battery pack 1 are brought into engagement with these contacting portions 55*a*–55*e*, which establishes electrical connection. Because the protrusion P1 of the contacting portions 55*c* and 55*e* is greater than the protrusion P2 of the contacting portions 55*a*, 55*b*, and 55*d*, the contacting portions 55*c* and 55*e* are brought into engagement with the conductive pads 2*c* and 2*e* before the contacting portions 55*a*, 55*b* and 55*d* are brought into engagement with the conductive pads 2*a*, 2*b*, and 2*d*. As a result, the battery pack 1 is electrically connected in sequential connection.

As shown in FIGS. 3A, 3B, 4, and 5, each terminal slot 11*a* is formed with a right and left pair of ribs 12 which extend vertically in the rear portion of the terminal slot 11*a* and a pair of guide grooves 13 which extend vertically behind these ribs 12. In addition, a lodging opening 14 is open to the back of the housing 11 in rear of the guide grooves 13, correspondingly to each terminal slot 11*a*. Into these terminal slots 11*a*, the terminals 50 are inserted upward, with the resilient portions 54 being first to enter the lower openings of the slots 11*a* and the lateral insertion guide portions 52 of the anchoring portions 51 fitting into the guide grooves 13. When the terminals 50 are fully in place, the upper ends of the insertion guide portions 52 come into contact with the upper ends of the guide grooves 13, and the lances 53 enter the lodging openings 14. As a result, the terminals 50 are locked therein and are prevented not only from moving upward by the engagement of the upper ends of the insertion guide portions 52 with the upper ends 13*a* of the guide grooves 13 but also from moving downward by the engagement of the lances 53 in the lodging openings 14. In this condition, the lower ends of the lances 53 are met by the lower edges 14*a* of the lodging openings 14. Thus, the terminals 50 are fixedly retained in the terminal slots 11*a* in a fully inserted position.

In this position, the contacting portions 55 of the terminals 50 protrude through the contact openings 15 (15*a*–15*e*) of the housing 11. Here, first protrusion-regulating portions 16 are provided on the upper edges of the contact openings 15*c* and 15*e*, and second protrusion-regulating portions 17 are provided on the upper edges of the contact openings 15*a*, 15*b*, and 15*d*. As clearly seen from the figures, the second protrusion-regulating portions 17 extend more downward than the first protrusion-regulating portions 16.

When the terminals 50 are inserted into the terminal slots 11*a*, each of the contacting portions 55 meets with a corresponding first or second protrusion-regulating portion 16 or 17. As the contacting portions 55 are pressed downward by the first or second protrusion-regulating portions 16 or 17, respectively, the resilient portions 54 are elastically deformed by the respective pressures. Therefore, even though the identical terminals 50 are employed in the terminal slots 11*a*, the contacting portions 55*c* and 55*e* of the terminals 50 which meet with the first protrusion-regulating portions 16 gain a relatively small downswing and a relatively large forward protrusion P1. On the other hand, the contacting portions 55*a*, 55*b*, and 55*d* of the terminals 50 which meet with the second protrusion-regulating portions 17 gain a relatively large downswing and a relatively small outward protrusion P2.

As described above, in the surface-contact connector 10 of the present invention, although the terminals 50 of identical shape are employed, different amounts of forward protrusion P1 and P2 are realized for the contacting portions 55 of the terminals 50 by varying the shapes of the protrusion-regulating portions 16 and 17. With these different protrusions P1 and P2, sequential connection is realized for the surface-contact connector 10 by a difference created in the timing of engagement of the contacting portions 55 of the connector 10 with the conductive pads 2*a*–2*e* of the battery pack 1 when the battery pack 1 is inserted as described previously.

The conductive pads 2*a*–2*e* of the battery pack 1 include a pad for power supply connection, a pad for grounding connection, and pads for signal transmission connection. It is preferable that the pad for power supply connection and the pad for grounding connection be brought into engagement with corresponding contacting portions 55 of the connector 10 before the pads for signal transmission connection. Therefore, in this embodiment, the conductive pads 2*c* and 2*e* are used for power supply connection and for grounding connection, respectively, and the conductive pads 2*a*, 2*b*, and 2*d* are used for signal transmission connection. Accordingly, the corresponding terminals 50 comprising the contacting portions 55*c* and 55*e* are used for power supply connection and for grounding connection, respectively, and the other terminals 50 are used for signal transmission connection.

In the surface-contact connector 10 of the above embodiment, two different protrusions P1 and P2 are set for the contacting portions 55. However, three different protrusions may be provided instead, each for power supply connection, for grounding connection and for signal connection. In this case, the terminal with the largest protrusion, i.e., the terminal to be brought into engagement first, is used for grounding connection, the terminal with the second largest protrusion is used for power supply connection, and the terminal with the smallest protrusion is used for signal transmission connection. Furthermore, in the above embodiment, the protrusion-regulating portions 16 and 17 engage with the upper surfaces of the contacting portions 55. However, alternatively, the amount of protrusion of the contacting portions 55 can be regulated by pressing the resilient portions 54 with protrusion-regulating portions which are formed as a dimple in the terminal slots 11*a* of the housing 11.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A surface contact connector for effecting sequential connection to conductive pads arranged in a planar array on a mating connector comprising:

a housing molded in one piece of insulating plastic material having a bottom, circuit board engaging face and a front, mating face adjacent the circuit board engaging face, and front and rear housing walls bridged by a top housing wall forming a series of terminal receiving cavities, contact portion receiving apertures of differing heights and having closed upper ends extending up the front housing wall so that wall ponions defining the upper ends are of different heights above the circuit board engaging face;

a series of identically stamped and formed metal terminal strips in respective terminal receiving cavities, each terminal strip comprising:

a circuit board connecting portion adjacent the circuit board engaging face; an anchoring portion in anchoring engagement with the housing adjacent the rear wall, anchoring the terminal in a respective housing cavity; a U-shaped resilient portion having first and second spring arm portions connected at respective upper ends to a bight adjacent the top wall, the first spring arm portion extending upwardly, adjacent the rear wall, from the anchoring portion, and the second spring arm portion extending downwards from the bight adjacent the front wall; and, a mating contact portion extending transversely from a free end of the second spring arm portion and having a mating tip protruding out from the aperture in a mating direction, one of the second spring arm portion and a pan of the mating contact portion located between the tip and the second spring arm portion, being in upwardly pressing engagement with a respective upper end wail portion of a respective aperture so that at least some of said contact portions protrude in a horizontal direction of mating engagement by different amounts and are located at different heights above the circuit board whereby engagement of the mating connector with respective contact portions by movement of the mating connector toward the mating face in both horizontal and downward directions will cause respective contact portions to swing downward and rearward away from respective and wall portions thereby effecting sequential connection to conductive pads of the mating connector.

2. A surface contact connector according to claim 1 wherein the anchoring portions comprise respective locking lances which diverge downwardly to respective free ends which engage respective upwardly facing locking ledges in the rear wall of the housing, resisting downward displacement of the terminal from the housing during mating engagement.

3. A surface contact connector according to claim 1 wherein the contact portion comprises a strip portion extending from the second arm, looping upwardly and extending backwardly over itself to a rear end which is in engagement with the second spring arm portion, the backwardly extending portion providing the engagement with the upper end wall portion of the contact portion receiving aperture.

4. A surface contact connector according to claim 3 wherein the rear end is bent to extend along a forward side of the second spring arm portion.

5. A surface contact connector according to claim 3 wherein the backwardly extending portion is upwardly inclined.

6. A surface contact connector according to claim 2 wherein the contact portion comprises a strip portion extending from the second arm, looping upwardly and extending backwardly over itself to a rear end which is in engagement with the second spring arm portion, the backwardly extending portion providing the engagement with the upper end wall portion of the contact portion receiving aperture.

* * * * *